US007938757B1

(12) United States Patent
Cockrell

(10) Patent No.: US 7,938,757 B1
(45) Date of Patent: May 10, 2011

(54) TRACK—MOBILE

(76) Inventor: Jerry M. Cockrell, Wabasha, MN (US)

( * ) Notice: Subject to any disclaimer, the term of this patent is extended or adjusted under 35 U.S.C. 154(b) by 0 days.

(21) Appl. No.: 12/731,321

(22) Filed: Mar. 25, 2010

(51) Int. Cl.
*A63B 22/00* (2006.01)
*A47D 13/00* (2006.01)
*B66C 17/06* (2006.01)

(52) U.S. Cl. ..... 482/69; 297/274; 297/DIG. 11; 182/37

(58) Field of Classification Search ..... 482/51, 482/69, 74, 66, 54, 908; 105/155; 182/3, 182/37; 297/274
See application file for complete search history.

(56) References Cited

U.S. PATENT DOCUMENTS

| | | | | | |
|---|---|---|---|---|---|
| 2,812,010 | A * | 11/1957 | Abdallah | ..... | 482/69 |
| 4,545,575 | A * | 10/1985 | Forjot | ..... | 482/69 |
| 4,911,426 | A * | 3/1990 | Scales | ..... | 482/69 |
| 4,948,118 | A * | 8/1990 | Miraglia | ..... | 482/55 |
| 5,458,550 | A * | 10/1995 | Braim et al. | ..... | 482/69 |
| 5,626,540 | A * | 5/1997 | Hall | ..... | 482/69 |
| 5,667,461 | A * | 9/1997 | Hall | ..... | 482/69 |
| 7,303,049 | B1 * | 12/2007 | Greenlee | ..... | 182/37 |
| 7,468,023 | B2 * | 12/2008 | Wu et al. | ..... | 482/69 |
| 2008/0287268 | A1 * | 11/2008 | Hidler | ..... | 482/69 |

* cited by examiner

*Primary Examiner* — Steve R Crow
(74) *Attorney, Agent, or Firm* — Thomas J. Nikolai; Nikolai & Mersereau, P.A.

(57) ABSTRACT

This invention relates to an apparatus which supports a user who is building back and leg muscles. This invention includes at least a track, a truck designed to run along the track and a sling for suspending a user from the truck. The track is of a design adapted to be secured to a ceiling joist. The truck of a size which is capable of supporting the weight of a user and of withstanding any forces which a user may impose upon the truck.

5 Claims, 3 Drawing Sheets

TRACK—MOBILE

BACKGROUND OF THE INVENTION

Individuals with muscular disabilities are often limited in their mobility. This includes their ability to move around a house and in daily activities. Many children born with muscular disabilities are often unable to walk or move independently at any point in their lives without some type of assistance.

Cerebral palsy (CP) is one form of physical disability which affects how a person can move. All types of CP are characterized by abnormal muscle tone, reflexes, motor development and coordination. Classically, children with CP have delayed development which can result in poor muscle form. Often, if a child has cerebral palsy, that child has neuromuscular conditions which affect his or her ability to walk or move independently; therefore, these individuals often rely on others or they use support devices to move around.

Vertebral bodies, and other weight bearing body parts, such as the legs, need gravitational loading forces to develop properly. Children with CP are not able to adequately develop the muscles they need to move; therefore weight bearing areas do not get adequate gravitational loading forces for proper development. It is known that children with CP need help in developing their muscles; but they will improve somewhat if they receive extensive care from specialists.

Currently, the devices available to assist users with muscular disabilities are bulky and large. These devices can sometimes be so large a user is unable to move them through typical doorways, hallways or other areas of a house or building. Often times the user is out-weighted by the device. Often the weight and mass of such an assist device will cause a user to encounter difficulties in operating it because of the resistance imposed by the device itself.

Devices of the class which children can use to move around in an effort to increase their muscular function are usually floor based. These devices have wheels for children to move. However, the wheels may get caught or stuck on surfaces such as carpeting, objects on the floor, or other such obstacles which lay around a house. This usually results in a frustrating and strength draining experience for the user.

Thus, there remains a need for an apparatus which has a small footprint, is light-weight and gives a user with muscular disabilities the freedom to move independently throughout his or her home while simultaneously providing a means for the user to develop necessary muscles. There is a need for a device which will not cause a user to get stuck on obstacles or inhibit a child's movement while the child is attempting to build muscular strength.

SUMMARY OF THE INVENTION

The present invention is directed to persons who need to develop muscles in their back and legs. This invention supports the user when the user wishes to work on developing such muscles. The apparatus of this invention generally includes a track attached to a ceiling surface, a truck which runs along the track and a sling which is attached to the truck and is capable of supporting a user. Preferably, the sling should be designed such that it allows for the user's feet to touch the floor while the user is supported by the sling when the user wishes to engage in muscle building activities.

BRIEF DESCRIPTION ON THE DRAWINGS

DETAILED DESCRIPTION

Figure 2:
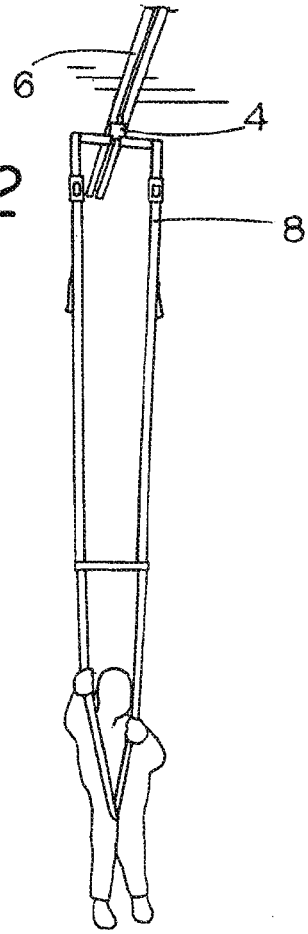
FIG. 2 is an illustration of the truck, track and sling in use by a human.

As shown in FIG. 2, the apparatus of this invention is a mobility assist device 2 that includes three main features, a truck assembly 4, a track 6 and a sling 8. The truck assembly 4 is designed to roll along the track 6 in a manner which can be controlled by the user. The track 6 is designed to be attached to a ceiling surface. Both the track 6 and the truck assembly 4 should be designed to have minimal footprint in the area in which they will be put to use. The track 6 and the truck assembly 4 should be designed such that a user encounters minimal obstacles and is able to move freely.

Figure 1:
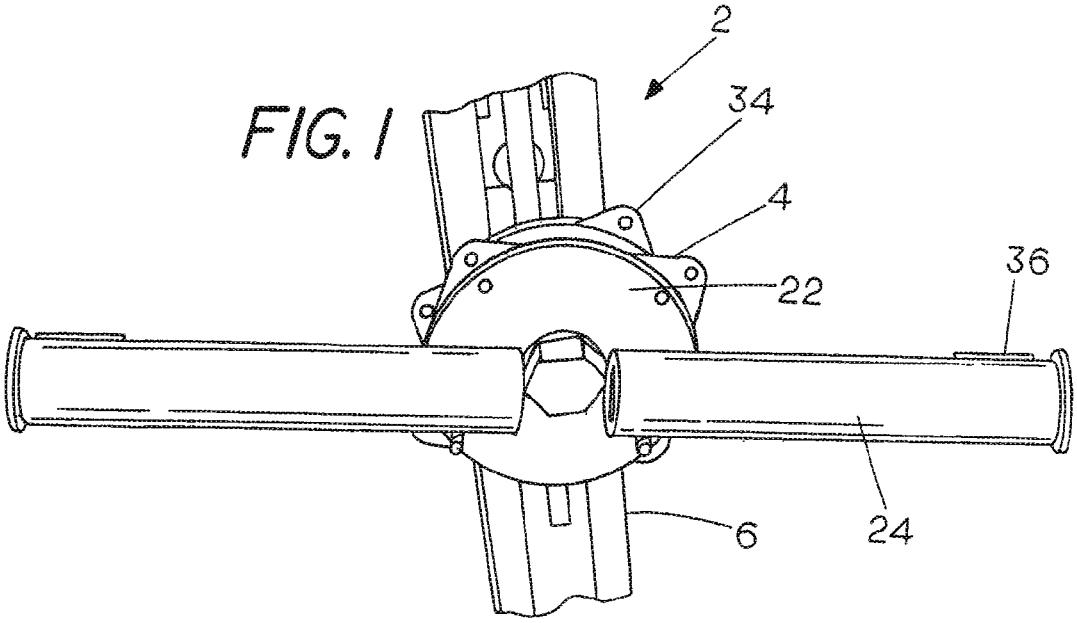
FIG. 1 is a fragmented perspective view of a truck on a portion of a track.
Figure 5:
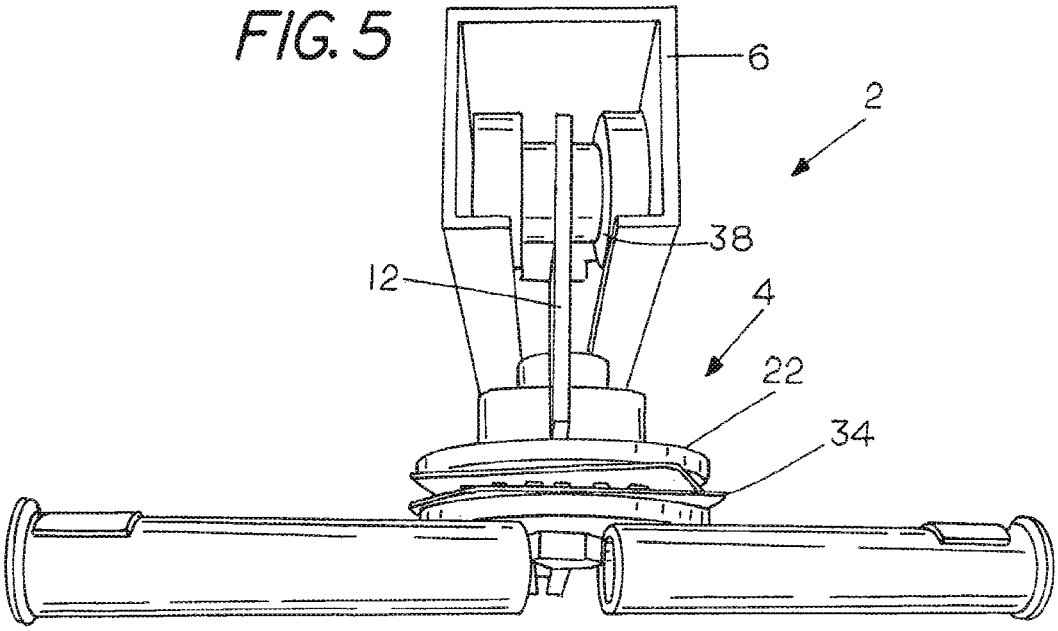
FIG. 5 is an illustration of the truck within the track.
Figure 6:
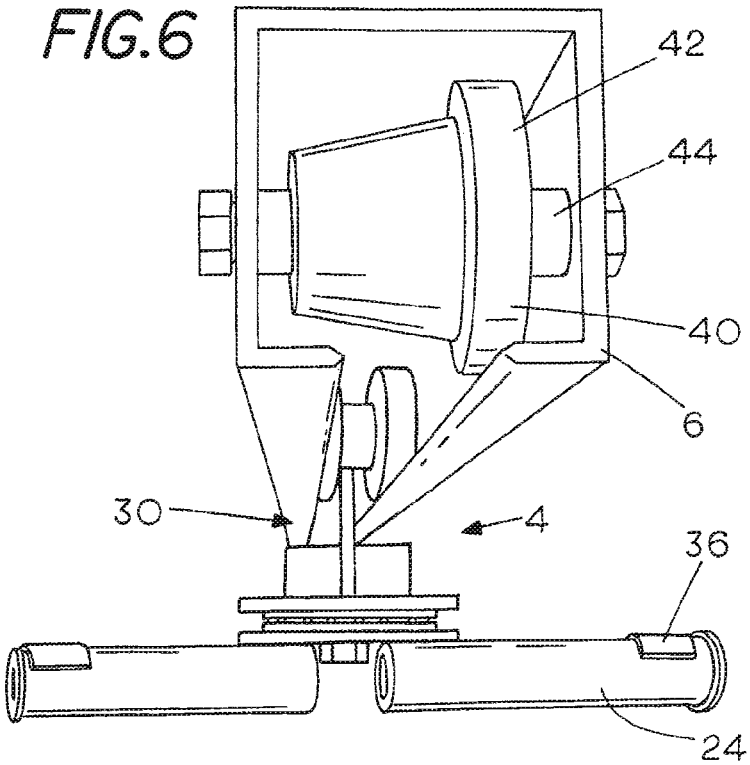
FIG. 6 is another view of the truck within the track.

As shown in FIGS. 1, 5 and 6, the truck assembly 4 is designed to ride within the track 6 and the track 6, in turn, should be designed to be fixed to and supported by a ceiling joist or other adequate structure member. The truck assembly 4 should further be designed to hold the sling 8 in such a manner that a user may fit within and be supported by the sling 8. The mobility assist device 2 should further be designed to support the weight of a user and the forces caused by a user during the user's movements.

In a contemplated embodiment of this invention, the truck assembly 4 is designed such that it has a first polygonal shaped plate 12. The polygonal shaped plate has an upper edge 14 slightly longer than its lower edge 16 and symmetrical along a center axis 18. The lower edge 16 of the first plate 12 should be centered below the upper edge 14 at a distance which allows the lower edge 16 to clear the track 6, as will be further explained. Extending from each end of the upper edge 14 are side edges 20. The side edges 20 extend between the upper edge 14 to the lower edge 16. These side edges 20 may be a straight edge or it may consist of multiple sides. In a contemplated embodiment of this invention, the side edges would first extend at a right angle downward half the height of the first plate then would be angled inward to meet with the lower edge 16. In any embodiment of this invention, the height of the truck assembly 4 should be sufficient for the lower edge 16, a second horizontal plate 22 and a sling support member 24 to clear the track 6 when the mobility assist device 2 is in use. The thickness dimensions of the first plate 12 should be sufficient to support the mass and forces of the user when the mobility assist device mobile 2 is in use.

The first plate 12 is attached to the second plate 22 in any manner known in the art. For example, the second plate 22 could be welded or otherwise attached to the lower edge of the first plate 12. The second plate 22 should be attached to the first plate 12 such that the second plate 22 is generally parallel to the plane of the ceiling and perpendicular to the first plate 12. The second plate 22 should be attached to the first plate 12 such that the center of the second plate 22 is welded to the center of the first plate 12. This second plate 22 should be of a size which can support the weight of a user, a swivel plate 34, a sling support member 24, a strap guide 36 and a sling 8 without bending or otherwise becoming distorted. In a preferred embodiment, the second plate 22 is circular in shape and between two and four inches in diameter and half of an inch and an eight of an inch in depth. In another preferred embodiment, the second plate 22 is square.

In an embodiment of the invention shown in FIG. 5, the swivel plate 34 may be mounted to the second plate 22 by means of a bolt. However, any equivalent means known in the art can be used for attaching the swivel plate 34 to the second plate. If a bolt is used it should extend through the center of the swivel plate 34, and the second plate 22 and into a cut-out formed in the lower edge 16 of the first plate 12. This bolt should be fastened with a nut and a lock washer to hold the nut and bolt in place. However, any manner for coupling the swivel plate 34 to the support structure 30, the second plate 22 and/or the first plate 12 is contemplated for this invention. The swivel plate 34 should be configured such that it can be easily rotated 360 degrees by a user who has minimal muscle capabilities. In an embodiment of the invention, the swivel plate 34 would be coupled to the second plate 22 such that the swivel plate 34 is parallel to the line of the ceiling.

Figure 3:
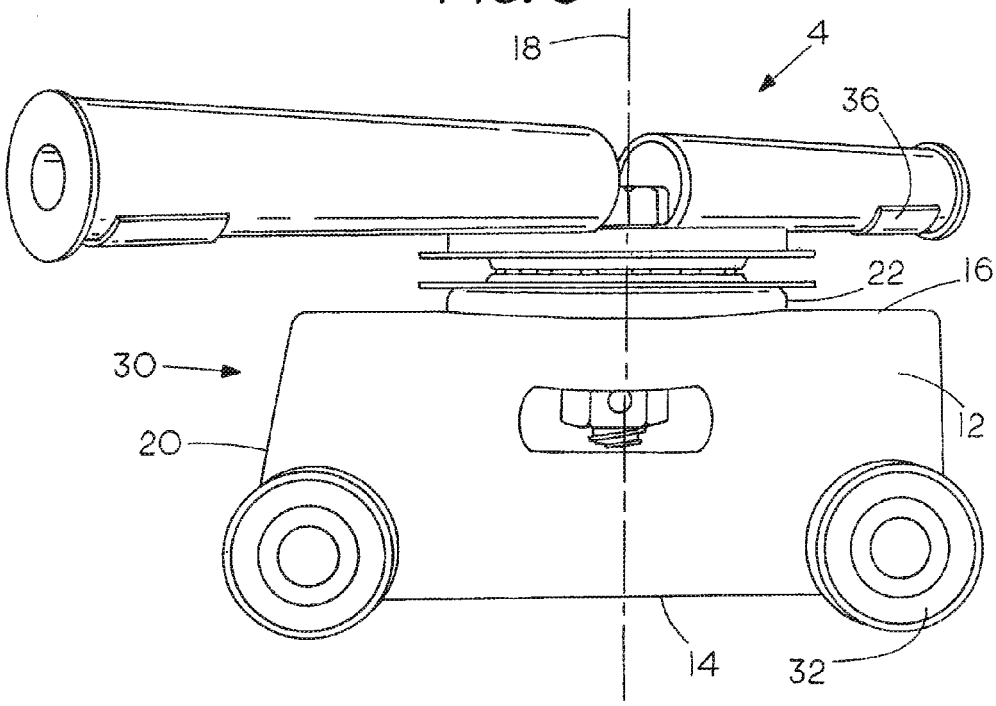
FIG. 3 is a perspective view of the truck.
Figure 4:
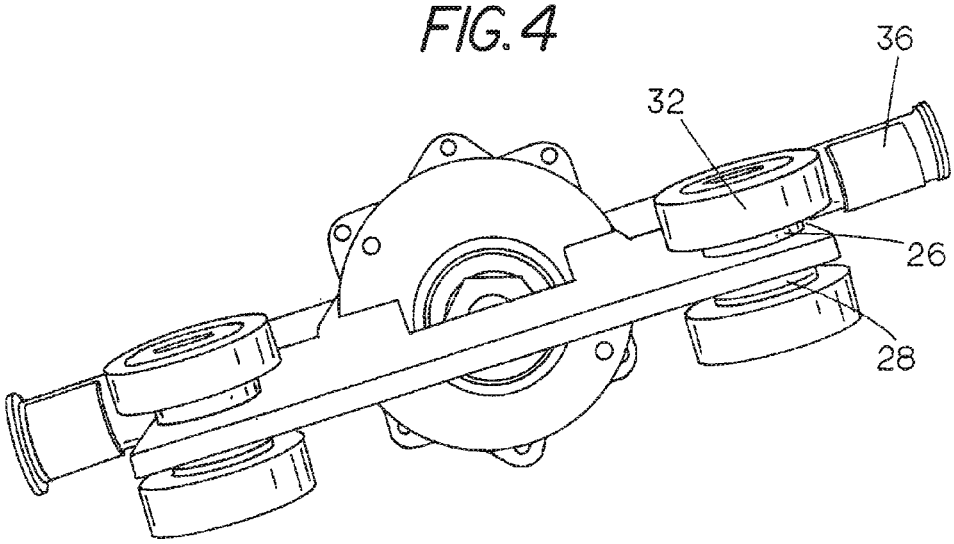
FIG. 4 is an illustration of a top view of a truck.

The truck assembly 4 is supported by at least one set of wheels or a roller along the channel of the track 6. The wheels or rollers are attached to axles extruding through the first plate 12. As illustrated in FIG. 4, the first plate 12 should have at least one through hole 26 for an axle 28 to be inserted. Preferably, the first plate 12 should have a plurality of through holes 26 through which axles 28 may be inserted to allow for a second set of wheels. In the embodiment shown in FIGS. 3 and 4, the truck assembly 4 has two through-holes 26 which are spaced an equal distance from each side of the first plate 12. The through holes 26 may be equal in size and shape. Without limitation, the center of each through hole 26 should be placed between half an inch and one inch from both the top edge 14 and the side edges 20 of the first plate 12

An axle 28 is placed in the through-hole 26 and a wheel 32 should be placed on each end of an axle 28 such that they are close to the inner side walls of the track 6 to straddle the slot 38 and stabilize the location of the first plate 12 close to the center of the slot 38. If there is more than one axle 28 then wheels 32 should be placed close to each end of each axle 28. The wheels 32 can of any size which allows the truck assembly 4 to roll efficiently along the track 6 when the user wishes to move.

A sling support member 24 which supports the sling, and therefore the user, is attached to the truck assembly. This sling support member 24 should be coupled to the swivel plate 34 in any manner which is capable of securing the sling support member 24 to the swivel plate 34 and capable of withstanding the forces exerted by a user in the sling 8. Examples of means for securing the sling support member 24 to the swivel plate 34 include bolting or welding. However, these examples should not be construed as limiting. The sling support member 24 could be a single bar extending the entire length or it could be two shorter bars, as illustrated, which extend the desired distance away from the truck assembly 4 and the track 6. The sling support member 24 should be of a size and shape which supports a user while the user is operating the mobility assist device 2 and is capable of evenly distributing the weight of the user across the entire length of the sling support member. The opposed ends of the sling support member 24 should be of equal distance away from the center of the support structure 30.

As shown in FIG. 4, the sling support member 24 may have strap guides 36 attached to it. The strap guides 36 can be manufactured in any manner known in the art such that a strap for the sling 8 can be secured into place between the sling support member 24 and the strap guide 36 and preventing the straps from slipping off the ends of the support members 24.

The truck assembly 4 described above is designed to run along a track 6, as shown in FIG. 5. This track 6 is of a width such that the wheels 32 of the truck assembly 4 roll along the channel of the track 6. The track 6 is also formed such that the user is not able to cause the truck 4 to fall off the track 6 during use. In a preferred embodiment the track 6 is formed from a length of rectangular tubing such that a channel is formed within the tubing and which has a slot 38 in the center to allow for movement of the truck assembly 4 within the track 6. The tubing from which the track 6 is constructed may be any width known in the art to sufficiently serve the purpose of allowing the truck 4 to run along the inside. The slot 38 within the channel of the track 6 should be wide enough to allow the first plate 12 of the truck assembly 4 to run through but not so wide that the wheels 32 could possibly come out of the track 6. In a contemplated embodiment, there should not be more clearance within the channel of the track 6 and wheels 32 than necessary so that there is minimal lateral movement of the truck assembly 4 within the track 6.

Located adjacent to each end of the track 6 is a stop device 40 to limit the travel of the truck assembly 4 and prevent it from rolling out of and end of the track 6, as illustrated in FIG. 6. Stop devices 40 can be of any variety known in the art which will not allow a user to cause the truck assembly 4 to roll out of the track 6 during any motions or movements by the user. At least one stop device 40 should be removable to allow the truck to be removed when desired. In an embodiment of the invention, the stop device 40 could be made from bumper 42 which is disposed in the track 6 and held in place with a through bolt 44. The stop 40 may also be a decorative end plate for the track 6 such that the inside of the track 6 cannot be seen when viewed from the ends.

As shown in FIG. 2, a sling 8 is held into place by the strap guides 36 on the sling support member 24. The sling 8 is designed to hold a body in an upward position, but still allow the user's legs hang downwards. The length of the sling 8 is such that the user's feet will touch the floor to assist the user in learning how to walk. The sling 8 is designed to support the weight of the user. The sling 8 should also be designed such that the straps of the sling are adjustable to accommodate the height of the user as the user grows and develops muscles.

In use, the track may be placed along any series of ceiling joists or other structural support members such that the track extends through multiple rooms. It is contemplated for the track to extend into multiple rooms of a house. Therefore, junctions and curved track segments can be designed which allow a user to navigate the truck through a house. Any design of a track is contemplated for use so long as the track and truck assembly work together to assist a user in moving through a room or rooms.

Thus, embodiments of the mobile assist device which allows a user to develop leg muscles are disclosed. One skilled in the art will appreciate the present teachings can be practiced with embodiments other than those disclosed. The disclosed embodiments and figures are presented for purposes of illustration and limitation.

What is claimed is:

1. An apparatus for providing limited mobility to a handicapped individual comprising:

(a) an elongated track comprising a tube defining a lumen of rectangular cross section, the tube having a longitudinal slit running the length dimension of one face of said track where the slit faces downward when the track is affixed to a ceiling joist of a building;

(b) a truck member having wheels for engaging the track for travel therealong;

(c) a swivel member carried by the truck at a location exterior to the track;

(d) at least one elongate arm attached to the swivel member where the length of the arm is greater than a width dimension of the track;

(e) a pair of elongate flexible slings suspended at one end from the at least one arm and extending downward therefrom for a distance that can be adjustably set; and (f) body-engaging seat member affixed to ends of the slings opposite the one end and configured such that feet of the handicapped individual can engage a floor of the building.

2. The apparatus of claim 1 wherein the truck member comprises a first plate member having first and second axels extending through a thickness dimension of the first plate member at spaced apart locations, the wheels being affixed to the axels on opposite sides of the first plate member and where the first plate member extends outward through said slit beyond the one face when the wheels straddle the slit within the lumen and a second plate member fixedly attached to a lower edge of the first plate member and extending perpendicularly to the first plate member.

3. The apparatus of claim 2 wherein said swivel member is affixed to the second plate member.

4. The apparatus of claim 3 wherein first and second arms extend radially outward from the swivel member with said pair of elongated flexible slings suspended individually from free end portions of the first and second arms.

5. The apparatus of claim 1 and further including stop members disposed in the lumen of the elongated track proximate opposed ends thereof, said stop members preventing the truck member from escaping out the ends of the tube of rectangular cross section.

* * * * *